US009046328B2

(12) United States Patent
Nauman et al.

(10) Patent No.: US 9,046,328 B2
(45) Date of Patent: Jun. 2, 2015

(54) SHOT SHELLS WITH PERFORMANCE-ENHANCING ABSORBERS

(71) Applicant: ENVIRON-METAL, INC., Sweet Home, OR (US)

(72) Inventors: Ralph Nauman, Albany, OR (US); Michael Clifford Sorensen, Sweet Home, OR (US)

(73) Assignee: Environ-Metal, Inc., Sweet Home, OR (US)

( * ) Notice: Subject to any disclaimer, the term of this patent is extended or adjusted under 35 U.S.C. 154(b) by 0 days.

(21) Appl. No.: 13/707,430

(22) Filed: Dec. 6, 2012

(65) Prior Publication Data

US 2013/0145951 A1 Jun. 13, 2013

Related U.S. Application Data

(60) Provisional application No. 61/568,591, filed on Dec. 8, 2011.

(51) Int. Cl.
*F42B 7/04* (2006.01)
*F42B 7/08* (2006.01)

(52) U.S. Cl.
CPC .... *F42B 7/04* (2013.01); *F42B 7/08* (2013.01)

(58) Field of Classification Search
CPC ..... F42B 7/00; F42B 7/02; F42B 7/04; F42B 7/08; F42B 7/10
USPC ..... 102/448–463; 86/11, 12, 18, 23, 25, 29, 86/30, 31, 1.1
See application file for complete search history.

(56) References Cited

U.S. PATENT DOCUMENTS

| | | | | | |
|---|---|---|---|---|---|
| 12,545 | A | * | 3/1855 | Davis | 102/452 |
| 34,806 | A | * | 3/1862 | Budd | 102/455 |
| 1,583,559 | A | | 5/1926 | Kenneweg | |
| 2,559,275 | A | * | 7/1951 | Brown et al. | 102/461 |
| 3,059,578 | A | * | 10/1962 | Hegge et al. | 102/506 |
| 3,092,026 | A | * | 6/1963 | Williams et al. | 102/455 |
| 3,093,073 | A | | 6/1963 | Lockwood et al. | |

(Continued)

FOREIGN PATENT DOCUMENTS

WO WO 86/05871 10/1986

OTHER PUBLICATIONS

S.P. Silvia, et al., Cork: Properties, Capabilities and Applications; *International Materials Reviews*, 2005. vol. 50, No. 6.

*Primary Examiner* — James S Bergin
(74) *Attorney, Agent, or Firm* — Dascenzo Intellectual Property Law, P.C.

(57) ABSTRACT

Shot shells with enhanced performance due to inclusion of an absorber between the shot wad and the shot payload. The absorber reduces the pressure within a shot gun's chamber during firing of the shell, such as by absorbing energy generated during the firing process, and may thereafter return some of the energy to the pellets as the absorber and pellets are propelled along the firearm's barrel. Accordingly, the absorber enables a shot shell to generate shot payload velocities that are greater than would be achieved without the absorber, typically at a lower internal chamber pressure. In some embodiments, the absorber has (1) a Young's Modulus of less than 2,000 psi (137.9 bar), (2) a compressive strength of at least 100 psi (6.9 bar) and/or less than 10,000 psi (689.5 bar), and/or (3) a tensile strength of at least 145 psi (10 bar) and/or less than 10,000 psi (689.5 bar).

21 Claims, 3 Drawing Sheets

(56) References Cited

U.S. PATENT DOCUMENTS

| | | | | |
|---|---|---|---|---|
| 3,270,669 | A | 9/1966 | Atkins et al. | |
| 3,422,761 | A * | 1/1969 | Whitmore | 102/453 |
| 3,491,690 | A * | 1/1970 | Knight | 102/448 |
| 3,656,433 | A * | 4/1972 | Thrailkill et al. | 102/455 |
| 3,756,155 | A * | 9/1973 | Smith | 102/455 |
| 3,996,865 | A | 12/1976 | Dwyer | |
| 4,103,621 | A | 8/1978 | Fackler | |
| 4,428,295 | A | 1/1984 | Urs | |
| 4,733,613 | A | 3/1988 | Bilsbury et al. | |
| 4,760,793 | A | 8/1988 | Herring, III | |
| 5,527,376 | A | 6/1996 | Amick et al. | |
| 5,713,981 | A | 2/1998 | Amick | |
| 6,202,561 | B1 | 3/2001 | Head et al. | |
| 6,258,316 | B1 * | 7/2001 | Buenemann et al. | 420/8 |
| 6,270,549 | B1 | 8/2001 | Amick | |
| 6,367,388 | B1 | 4/2002 | Billings | |
| 6,415,719 | B1 | 7/2002 | Buccelli et al. | |
| 6,447,715 | B1 | 9/2002 | Amick | |
| 6,749,802 | B2 | 6/2004 | Amick | |
| 6,931,993 | B1 * | 8/2005 | Manole et al. | 102/458 |
| 7,059,233 | B2 | 6/2006 | Amick | |
| 7,217,389 | B2 | 5/2007 | Amick | |
| 7,232,473 | B2 | 6/2007 | Elliott | |
| 7,267,794 | B2 | 9/2007 | Amick | |
| 7,383,776 | B2 | 6/2008 | Amick | |
| 7,640,861 | B2 | 1/2010 | Amick | |
| 7,765,933 | B2 | 8/2010 | Goodlin et al. | |
| 2002/0189485 | A1 | 12/2002 | Diller | |
| 2006/0118211 | A1 | 6/2006 | Elliott | |
| 2010/0175575 | A1 | 7/2010 | Amick | |
| 2010/0281744 | A1 | 11/2010 | Meyer | |
| 2010/0294158 | A1 | 11/2010 | Poore | |
| 2011/0203477 | A1 | 8/2011 | Amick | |

* cited by examiner

SHOT SHELLS WITH PERFORMANCE-ENHANCING ABSORBERS

RELATED APPLICATION

The present application claims priority under 35 U.S.C. §119 to U.S. Provisional Patent Application Ser. No. 61/568,591, which was filed on Dec. 8, 2011 and the complete disclosure of which is hereby incorporated by reference.

FIELD OF THE DISCLOSURE

The present disclosure is directed generally to firearms ammunition, and more particularly to shot shells that include a performance-enhancing absorber between the shot wad and the shot pellet(s).

BACKGROUND OF THE DISCLOSURE

When producing firearms ammunition, care must be taken that a maximum chamber pressure of the corresponding firearm is not exceeded when a cartridge is fired therefrom. In the U.S., ANSI/SAAMI standard Z299.2:1992 sets forth the maximum average chamber pressure for various firearms, including shot guns. SAAMI refers to the Small Arms and Ammunition Manufacturers' Institute, which is an organization that develops firearms and ammunition standards, coordinates technical data, and promotes firearms safety. Conventionally, shot shells are designed so that when the shot shell is fired, such as by a shot gun, the pressure generated within the shot gun's chamber does not exceed the maximum chamber pressure.

As illustrative, non-exclusive examples, Table 1 presents SAAMI pressure specifications for a variety of gauges of shot shells.

TABLE 1

SAAMI Shot Gun Pressure Specifications (piezoelectric measurements)

| Cartridge | Maximum Average Pressure (psi) | Maximum Average Pressure (bar) |
|---|---|---|
| 10 gauge | 11,000 (all) | 758.4 (all) |
| 12 gauge | 11,500 (all but 3½ inch mag) | 792.9 (all but 8.9 cm mag) |
| 12 gauge 3½" mag | 14,000 | 965.3 |
| 16 gauge | 11,500 (all) | 792.9 (all) |
| 20 gauge | 12,000 (all) | 827.4 (all) |
| 28 gauge | 12,500 (all) | 861.8 (all) |
| .410 Bore 2½" | 12,500 | 861.8 |
| .410 Bore 3" | 13,500 | 930.8 |

However, there is a competing demand for shot shells that, when fired, generate higher pellet velocities. One way to increase the velocity of the pellets fired from a shot shell is to increase the amount of propellant (i.e., smokeless powder or other highly combustible charge) in the shot shell. Another way is to select a particular type of propellant, such as an easier-to-ignite propellant and/or faster burning propellant, that generates more pressure within the shot gun's chamber when the shot shell is fired, with this increased pressure typically correlating to an increased velocity of the shot pellets.

A conventional approach to balancing velocity and pressure is to utilize slower burning propellants that will generate a lower maximum chamber pressure. However, a drawback of this approach, especially in colder climates, is that the slower burning propellants often are more difficult to ignite, and therefore may result in shot shells that do not fire reliably.

SUMMARY OF THE DISCLOSURE

The present disclosure is directed to shot shells with performance-enhancing absorbers that are positioned between the shot wad and the shot payload. The absorber is configured to reduce the pressure within a firearm's chamber when the shot shell is fired, such as by absorbing some of the energy that is generated during the firing process and which otherwise would generate pressure within the chamber. However, the absorber also is concurrently configured to enable a shot shell to generate shot payload velocities that are greater than the velocities that would be achieved if the absorber was not present, typically at a lower internal chamber pressure. In some embodiments, the absorber may be sufficiently resilient to impart at least a portion of the absorbed energy to the shot pellets after the absorber and shot pellets leave the shot shell during firing of the shot shell.

In some embodiments, the absorber has a Young's Modulus of less than 2,000 psi (137.9 bar). In some embodiments, the absorber has a compressive strength of at least 100 psi (6.895 bar) and/or less than 10,000 psi (689.5 bar). In some embodiments, the absorber has a tensile strength of at least 145 psi (10 bar) and/or less than 10,000 psi (689.5 bar). In some embodiments, the absorber covers at least half, at least 75%, or even all of the interior (shot pellet/payload-facing) face or surface of the shot wad. In some embodiments, the absorber further extends into the region of the shot shell containing the shot pellets, and in some embodiments may be intermixed with shot pellets within this region.

In some embodiments, the absorber is formed from at least one of cork, rubber, an elastomer, felt, cardboard, expanded polystyrene, acrylonitrile butadiene styrene (ABS), and a synthetic foam, such as of polyurethane, polystyrene, polyethylene or polypropylene. In some embodiments, the absorber takes the form of at least one ball, layer, disc, mat, or block, and in some embodiments, the absorber takes the form of a plurality of balls, layers, discs, mats, blocks, particles, fragments, granules, or pieces. In some embodiments, the absorber is inserted into the shot shell's casing, or payload region after the shot wad and before the shot pellets. In some embodiments, the absorber is inserted into the shot cup, and/or into contact with the pellet-facing region or surface of the wad, before insertion of the shot payload into the shot wad and/or shot shell casing. In some embodiments, the absorber is inserted as a liquid into the shot wad and cured to form a solid therein. In some embodiments, the absorber is formed and/or shaped before insertion into the shot wad and/or payload region of the shot shell.

DETAILED DESCRIPTION AND BEST MODE OF THE DISCLOSURE

Figure 1:
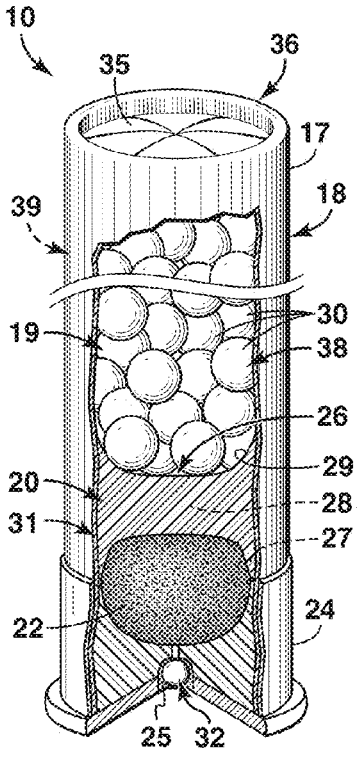
FIG. 1 (Prior Art)
FIG. 1 is a schematic, partially broken away illustration of a conventional shot shell.
Figure 2:
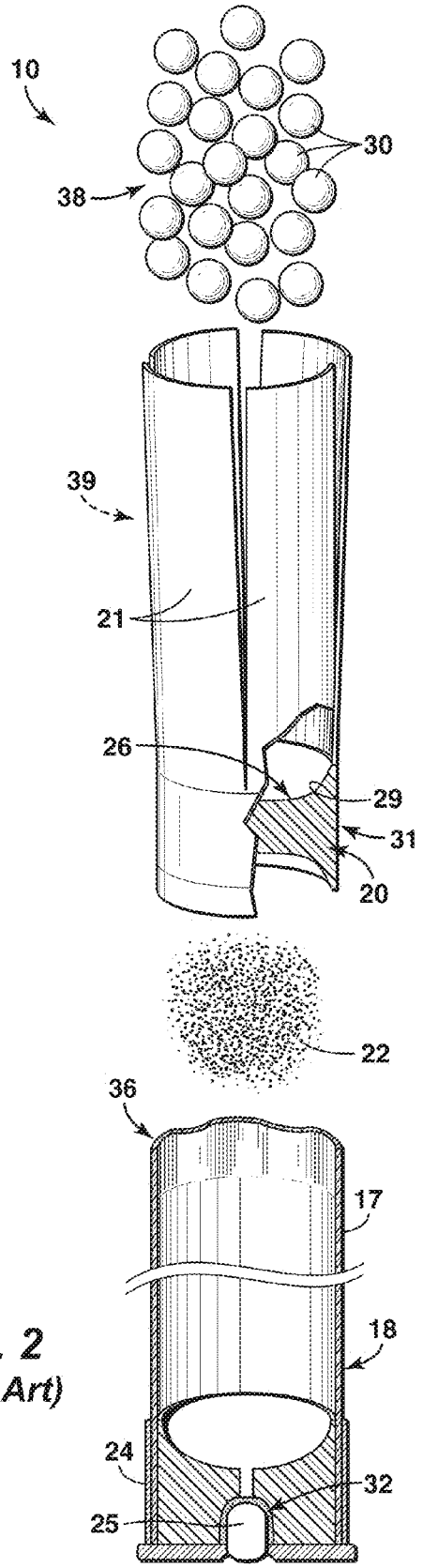
FIG. 2 (Prior Art)
FIG. 2 is an exploded elevation view of a conventional shot shell.

An example of a conventional shot shell is schematically illustrated in FIGS. 1 and 2 and is generally indicated at 10. Shot shell 10 is shown including a head, or head portion, 24, a shot shell case, or casing, 17, and a mouth region 36. Shot shell 10 further includes an ignition device 32, such as primer, or priming mixture, 25, which is located behind a propellant, or powder, 22, which also may be referred to as the charge 22 of the shot shell. Propellant 22 and primer 25 are located behind a partition 31, namely, a wad 20, which serves to segregate the propellant and the primer from the shot shell's payload 38. Powder 22 additionally or alternatively may be referred to as smokeless powder or gun powder. Wad 20 additionally or alternatively may be referred to as a shot wad 20, and it may take a variety of suitable shapes and sizes.

Casing 17 and head 24 additionally or alternatively may be referred to as forming a housing 18 of the shot shell. As indicated in FIG. 1, housing 18 (and/or casing 17) may be described as defining an internal chamber, or internal compartment, 19 of the shot shell. When the shot shell is assembled, at least propellant 22, wad 20, and payload 38 are inserted into the internal compartment, such as through mouth region 36. After insertion of these components into the internal compartment, mouth region 36 is sealed or otherwise closed, such as via any suitable closure 35. As an illustrative, non-exclusive example, the region of the casing distal head 24 may be folded, crimped, or otherwise used to close mouth region 36.

Payload 38 additionally or alternatively may be referred to as a shot charge, or shot load, 38. Payload 38 typically will include a plurality of shot pellets 30. The region of shot shell 10, casing 17, and/or wad 20 that contains payload 38 may be referred to as the payload region 39 thereof. In a conventional shot shell, the payload region 39 of the shot wad contains only shot pellets 30, with a pellet-facing surface of the wad, and/or of the wad's shot cup 26, directly engaging at least some of the shot pellets. As used herein, shot cup 26 may additionally or alternatively be referred to as a wad cup and/or as an end region of the wad that generally faces away from the head and/or toward the payload region. Accordingly, when shot shell 10 is fired, the initial impulse, or impact force, generated by the combustion of the shell's charge is conveyed through the wad directly to the pellets. Typically, the greatest pressure within the shot gun's chamber is experienced in, or proximate, the shot cup, where these forces are first imparted to the shot pellets. Correspondingly, the region of the shot gun's barrel that is most likely to be damaged or fail is the region of the barrel that surrounds the shot cup region of a shot shell as the shot shell is being fired.

Wad 20 typically defines a pellet-facing surface 29 that extends and/or faces generally toward mouth region 36 and away from head 24 (when the wad is positioned properly within an assembled shot shell). Wad 20 may include at least one gas seal, or gas seal region, 27, and at least one deformable region 28, between the shot cup and the propellant. Gas seal region 27 is configured to engage the inner surface of the shot gun's chamber and barrel to restrict the passage of gasses, which are produced when the shot shell is fired (i.e., when the charge is ignited), along the shot gun's barrel. By doing so, the gasses are forced to propel the wad, and the payload of shot pellets 30 contained therein, from the chamber and along and out of the shot gun's barrel. Deformable region 28 is designed to crumple, collapse, or otherwise non-elastically deform in response to the setback, or firing, forces that are generated when the shot shell is fired and the combustion of the propellant rapidly urges the wad and payload from being stationary to travelling down the barrel of the shot gun at high speeds.

As shown in FIG. 1, at least some of the plurality of shot pellets 30 in assembled shot shell 10 engage pellet-facing surface 29 of the wad. In the illustrated embodiment, wad 20 includes and/or defines a shot cup, or shot cup region, 26, which has a generally concave configuration and defines region of the pellet-facing surface that is closest to head 24. By "shot cup," it is meant that the wad defines a concave portion of the payload region that generally faces, or opens, toward mouth region 36. The specific size and geometric shape of the shot cup, when present, may vary, and the concave configuration of FIG. 1 is not required to all embodiments. Similarly, and as perhaps best seen in FIG. 2, shot wad 20 may include one or more sidewalls 21 that extend from the shot cup and around the payload region 39 of the wad and/or shot shell. In practice, the sidewalls contain the plurality of shot pellets within the assembled shot shell, and when the shot shell is fired, the sidewalls are intended to protect the inner surface of the shot gun's barrel from being contacted, and thus potentially damaged, by the shot pellets as the wad and plurality of shot pellets travel down the barrel. In the illustrated example, the wad includes a plurality of sidewall sections that are joined together proximate the shot cup region of the wad and which are not secured together proximate the forward/mouth region of the shot cup. Although this is not required, such a configuration enables the sidewall regions to flare away from each other after the wad exits the shot gun's barrel after the shot shell is fired, with this flaring increasing the wind resistance of the wad and slowing the wad, thereby separating it from the plurality of shot pellets and reducing the distance that it travels from the shot gun.

A shot shell may include as few as a single shot pellet 30, which perhaps more appropriately may be referred to as a shot slug, and as many as dozens or hundreds of individual shot pellets 30. The number of shot pellets 30 in any particular shot shell will be defined by such factors as the size and geometry of the shot pellets, the size and shape of the shell's casing and/or wad, the available volume in the casing to be filled by shot pellets 30, etc. For example, a double ought 00 buckshot shell typically contains nine shot pellets having diameters of approximately 0.3 inches (0.762 cm), while shot shells that are intended for use in hunting birds, and especially smaller birds, tend to contain many more shot pellets.

Shot pellets 30 may be formed from a variety of suitable materials and may have a variety of shapes. Illustrative, non-exclusive examples of suitable materials for shot pellets include lead, tin, bismuth, steel, copper, tungsten, alloys of tungsten with one or more other metals, alloys of tungsten, nickel, and iron, alloys and/or combinations of the preceding metals, etc., although lead often will not be used in applications where it is desirable or required to utilize non-toxic materials, such as for waterfowl hunting. Illustrative, non-exclusive examples of shot pellet shapes include spheres, spheroids, tear drops, belted spheres, pancake shapes, irregular shapes, etc. Although not required to all shot shells 100, it is within the scope of the present disclosure to manipulate shot pellet loading patterns, i.e., distributions and locations of the two or more different types of shot pellet morphologies within a single shot shell. These loading patterns may be utilized to improve the packing density of shot pellets within the shell, to impact general pattern uniformity, and/or to impact shot pattern diameters. Illustrative, non-exclusive examples of shot pellets, shot pellet compositions, methods of manufacturing shot pellets, shot shell components, and/or shot shell configurations are disclosed in U.S. Pat. Nos. 1,583,559, 3,996,865, 4,760,793, 5,527,376, 5,713,981, 6,202,561, 6,270,549, 6,367,388, 6,415,719, 6,447,715, 6,749,802, 7,059,233, 7,217,389, 7,232,473, 7,267,794, 7,383,776, 7,640,861, and 7,765,933, and in U.S. Patent Application Publication Nos. 2006/0118211, 2010/0175575, 2011/0203477, and 2010/0294158, the disclosures of which are hereby incorporated by reference.

When a shot shell is fired, the combustion of the primer and propellant generates pressure within the shot gun's chamber, and this generated pressure forces the shot wad and the shot payload away from the propellant, typically along and out of the barrel of the shot gun (or other firearm). The pressure within the shot gun's chamber during this process may be significant, with such factors as the amount and type of propellant contributing to the generated pressure. Relative increases in this pressure typically correlate to increased velocity of the shot payload as it exits the barrel of the shot gun, but too much pressure may damage the shot gun. As illustrative, non-exclusive examples, this damage may range from scoring and/or marring of the inner surface of the shot gun's barrel to rupturing, exploding, or other piercing and/or shattering of the shot gun's barrel.

Shot shell 10 and its components have been schematically illustrated in FIGS. 1 and 2 and are not intended to require a specific shape, size, or quantity of the components thereof. The length and diameter of the overall shot shell 10 and its casing 17, the amount of primer 25 and propellant 22, the shape, size, and configuration of wad 20, the type, shape, size, and/or number of shot pellets 30, etc. all may vary within the scope of the present disclosure. For the purpose of simplifying the present discussion, references have been and will continue to be made to shot guns as the firearms in which shot shells are used, but shot shells according to the present disclosure may be used with any firearm that is sized or otherwise configured to receive and fire a shot shell.

Figure 3:
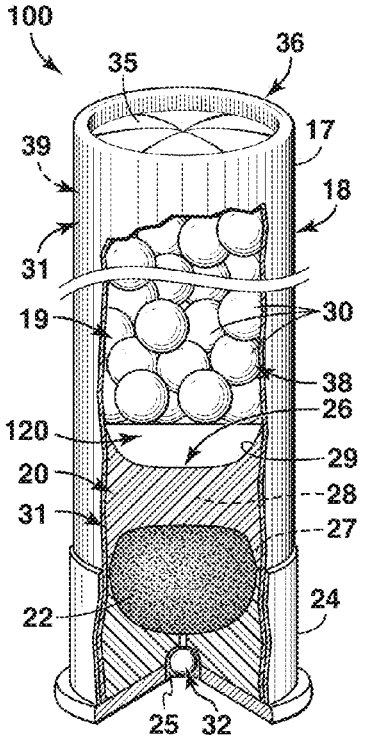
FIG. 3 is a schematic, partially broken away illustration of a shot shell containing an absorber according to the present disclosure.
Figure 4:
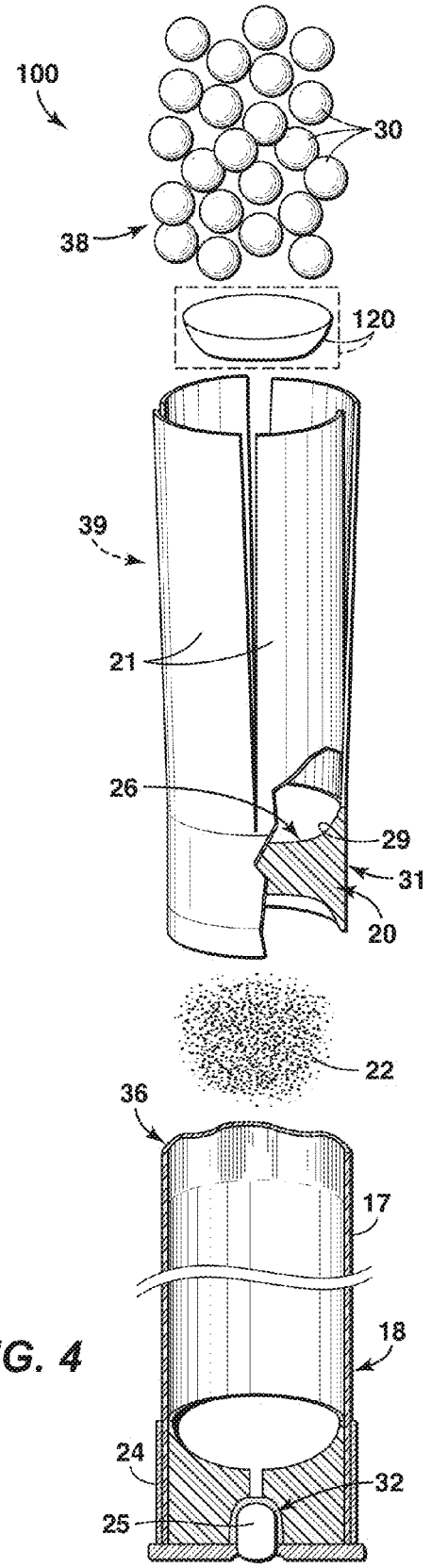
FIG. 4 is an exploded elevation view of a shot shell containing an absorber according to the present disclosure.

In FIGS. 3 and 4, a shot shell according to the present disclosure is schematically illustrated and is generally indicated at 100. Although not required to all embodiments, apart from the to-be-discussed absorber 120, shot shell 100 may include the same components, subcomponents, materials, variants, dimensions, etc., as conventional shot shell 10. Accordingly, the previously described components of shot shell 10 that may be present in shot shell 100 are not described again in connection with FIGS. 3 and 4. Moreover, elements that serve a similar, or at least substantially similar, purpose are labeled with like numbers in FIGS. 1-10, and these elements may not be discussed in detail herein with reference to each of FIGS. 1-10. Similarly, all elements may not be labeled in each of FIGS. 1-10, but reference numerals associated therewith may be utilized herein for consistency. In general, elements that are likely to be included in a given embodiment of shot shells 100 according to the present disclosure are illustrated in solid lines in FIGS. 3-10, while elements that are optional to a given embodiment are illustrated in dashed lines. However, elements that are shown in solid lines are not essential to all embodiments, and an element shown in solid lines may be omitted from a particular embodiment without departing from the scope of the present disclosure.

Unlike a conventional shot shell, such as shot shell 10, shot shell 100 includes an absorber 120 that is within the payload region of the shot shell, such as being at least partially or even completely within the shot cup, being within a portion of the payload region that otherwise would be occupied by shot pellets in a conventional shot shell (such as shot shell 10), and/or being inserted into the shot shell after insertion of the wad and before insertion of the plurality of shot pellets. As schematically illustrated in FIGS. 3 and 4, absorber 120 is present within shot cup 26 of wad 20 and thereby separates the portion of the pellet-facing surface 29 defined by the shot cup from the plurality of shot pellets 30. In FIG. 4, absorber 120 is schematically illustrated in dashed lines to provide a graphical depiction that the absorber may take a variety of shapes, sizes, and forms without departing from the scope of the present disclosure. Illustrative, non-exclusive examples of such absorbers are described, illustrated, and/or incorporated in more detail herein.

Functionally, absorber 120 is configured to absorb some of the energy that is/are produced during firing of the shot shell and which otherwise would be converted into pressure and/or forces within the shot gun's chamber. This absorption of some of the initial energy generated when the shot shell is fired has the effect of reducing the pressure within the chamber, as compared to the pressure that would be generated in the chamber if the shot shell did not include absorber 120. Accordingly, shot shell 100 may (but is not required to) utilize a type and/or quantity of propellant and/or primer that otherwise would generate, when the shot shell is fired, a pressure within the chamber that exceeds a maximum chamber pressure, such as a predetermined maximum pressure, a rated or recommended maximum pressure, a SAAMI or other industry standard, etc. Furthermore, shot shell 100 may (but is not required to) utilize faster burning, easily lit, propellants that generate higher pellet velocities (such as due to the generation of a greater amount of gas and/or due to a quicker generation of gas during combustion of the propellant), with the presence of absorber 120 preventing the propellants from generating chamber pressures that exceed a corresponding maximum (rated) chamber pressure. The predetermined maximum pressures and/or chamber pressure limits expressed herein may be referred to as maximum rated pressures, maximum average pressures, and/or maximum chamber pressures, and the pressure generated during the firing of a particular shot shell may be referred to as the actual pressure, actual chamber pressure, actual maximum average pressure, etc.

Although not required to all embodiments, absorber 120 optionally may be configured to release, or impart, some of the absorbed energy to the shot pellets after the wad, absorber, and shot pellets have been propelled out of the shot gun's chamber. In such an embodiment, the absorber may be described as reducing the initial (peak) pressure generated within the shot gun's chamber by absorbing some of the energy produced therein, and thereafter imparting at least a portion of the energy to the shot pellets by exerting forces thereupon. As an illustrative, non-exclusive example, in some embodiments, the absorber may be sufficiently resilient to deform while absorbing energy as the shot shell is fired, and thereafter transmit some of the absorbed energy to the shot pellets as the absorber returns to, or at least toward, its prefiring configuration and/or after the absorber reaches it elastic deformation limit. As another illustrative, non-exclusive example, the absorber optionally may be configured to utilize the absorbed energy to fragment or break into particles, such as to convert a solid absorber 120 into particulate or powder, including particulate and/or powder that has a smaller average cross-sectional area than shot pellets 30, that has an average cross-sectional area that is less than 50%, less than 75%, less than 90%, or even less than 95% of the cross-sectional area of the shot pellets.

Absorber 120 additionally or alternatively may be referred to herein as a/an energy _____, _____ material, _____ region, energy-absorbing _____, energy-distributing _____, setback energy absorbing _____, force-absorbing _____, setback force-absorbing _____, pressure-reducing _____, energy-absorbing frangible _____, and/or energy-absorbing-and-returning _____, with "_____" being "absorber," "insert," "structure," and/or "material."

Absorber 120 may be, and typically is, formed from a different material than the wad or shot pellets, and absorber 120 is separately formed from the wad. It is within the scope of the present disclosure that absorber 120 may be inserted into wad 20 prior to or after insertion of the wad into casing 17 of shot shell 100. It also is within the scope of the present disclosure that absorber 120 may be attached to wad 20 within payload region 39 thereof, such as by being coupled or otherwise attached to the shot cup of the wad, although it is also within the scope of the present disclosure that the absorber may be in contact with the wad, such as the shot cup thereof, without being attached thereto. It further is within the scope of the present disclosure that the absorber may be formed or otherwise fabricated and thereafter inserted (as one or more solid components) into the wad, however, it is also within the scope of the present disclosure that the absorber may be inserted into the wad as a liquid that is thereafter cured or otherwise solidified into a solid component.

Absorber 120 according to the present disclosure may be formed of any suitable material(s), shape(s), and/or number of components/pieces to provide the desired pressure reduction during firing of a shot shell 100. Illustrative non-exclusive examples of suitable materials for absorber 120 include one or more of cork, elastomers, styrofoam, expanded polystyrene, acrylonitrile butadiene styrene (ABS), rubber, felt, cardboard, compressed paper or card stock, synthetic foams, such as which may be formed from polyurethane, polystyrene, polyethylene, and/or polypropylene. In some embodiments, absorber 120 may be formed from a material that is different from the material(s) used to form the shot pellets and the wad of a shot shell 100, such as a non-metallic, non-plastic material. Illustrative, non-exclusive examples of suitable shapes for absorber 120 include one or more sphere/ball, spheroid, ovoid, ellipsoid, hemisphere, block, disc, mat, layer, and/or regular or irregular pellets/particles/pieces (such as crumbled cork, rubber, styrofoam, etc.).

Although not required for all absorbers 120 according to the present disclosure, absorber 120 may cover at least 25% of the internal (pellet-facing) surface of the wad's shot cup, and in some embodiments may cover at least 50%, at least 75%, at least 90%, at least 95%, at least 97%, at least 99%, 40-75%, 60-90%, 80-95%, 85-97%, 90-98%, 95-99%, or even all of the internal (pellet-facing) surface of the wad's shot cup. In some embodiments, at least a portion of absorber 120 may (but is not required to) extend into the region of the wad where the shot pellets are housed and/or may be intermixed with or otherwise extend between adjacent shot pellets within the payload region of the shot shell. In some embodiments, absorber 120 may have a cross-sectional area (measured transverse to the long axis of shot shell 100 after proper insertion of the absorber into the shot shell's wad) that is at least 75%, at least 80%, at least 85%, at least 90%, at least 95%, or at least 98% of the internal cross-sectional area of the wad measured in the same plane. However, extending into the pellet region of the wad and/or having a cross-sectional area that is at least 75% of the internal cross-sectional area of the wad is not required to all absorbers 120 according to the present disclosure.

In some embodiments, absorber 120 has a diameter, measured transverse to the long axis of the shot shell after proper insertion of the absorber into the wad thereof, that is less than the diameter of the wad, and optionally at least 0.01 inches (0.025 cm) smaller, at least 0.02 inches (0.051 cm) smaller, at least 0.03 inches (0.076 cm) smaller, at least 0.05 inches (0.127 cm) smaller, at least 0.08 inches (0.203 cm) smaller, at least 0.09 inches (0.229 cm) smaller, at least 0.1 inches (0.254 cm) smaller, 0.2 inches (0.508 cm) smaller, 0.3 inches (0.762 cm) smaller, 0.01-0.15 inches (0.025-0.038 cm) smaller, 0.03-0.12 inches (0.076-0.305 cm) smaller, 0.05-0.11 inches (0.127-00.279 cm) smaller, 0.06-0.1 inches (0.154-0.254 cm) smaller, and/or 0.07-0.09 inches (0.178-0.229 cm) smaller. When shot shell 100 is a 12-gauge shell, an absorber 120 in the form of a 14 mm ball has proven effective, and when shot shell 100 is a 10-gauge shell, an absorber in the form of a 16 mm ball has proven effective, although other shapes and/or sizes of absorbers (including larger and/or smaller sizes) may be used without departing from the scope of the present disclosure.

Illustrative, non-exclusive examples of properties of absorber 120 include at least one of (and optionally, at least two of, at least three of, at least four of, or all of) the following:

- a Young's Modulus of less than 500,000 psi (34,474 bar), less than 250,000 psi (17,237 bar), less than 150,000 psi (10,342 bar), less than 100,000 psi (6,895 bar), less than 75,000 psi (5,171 bar), less than 50,000 psi (3,447 bar), less than 25,000 psi (1,724 bar), less than 10,000 psi (689 bar), less than 5,000 psi (345 bar), less than 2,500 psi (172 bar), less than 2,000 psi (138 bar), less than 1,500 psi (103 bar), in the range of 500-2,000 psi (34-138 bar), in the range of 1,000-3,000 psi (69-207 bar), in the range of 1,500-5,000 psi (103-345 bar), and/or in the range of 5,000-20,000 psi (345-1379 bar), etc.;
- a specific Young's Modulus of at least 1.45 psi/(g/cc) (0.10 bar/(g/cc)), at least 5 psi/(g/cc) (0.34 bar/(g/cc)), at least 10 psi/(g/cc) (0.69 bar/(g/cc)), at least 25 psi/(g/cc) (1.7 bar/(g/cc)), at least 50 psi/(g/cc) (3.5 bar/(g/cc)), at least 75 psi/(g/cc) (5.2 bar/(g/cc)), at least 100 psi/(g/cc) (6.9 bar/(g/cc)), at least 150 psi/(g/cc) (10.3 bar/(g/cc)), at least 200 psi/(g/cc) (13.8 bar/(g/cc)), at least 250 psi/(g/cc) (17.2 bar/(g/cc)), less than 300 psi/(g/cc) (20.7 bar/(g/cc)), less than 290 psi/(g/cc) (20.0 bar/(g/cc)), less than 250 psi/(g/cc) (17.2 bar/(g/cc)), less than 200 psi/(g/cc) (13.8 bar/(g/cc)), less than 150 psi/(g/cc) (10.3 bar/(g/cc)), less than 100 psi/(g/cc) (6.9 bar/(g/cc)), less than 75 psi/(g/cc) (5.2 bar/(g/cc)), less than 50 psi/(g/cc) (3.5 bar/(g/cc)), less than 25 psi/(g/cc) (1.7 bar/(g/cc)), less than 10 psi/(g/cc) (0.69 bar/(g/cc)), and/or less than 5 psi/(g/cc) (0.34 bar/(g/cc));
- a compressive strength of at least 100 psi (6.9 bar), at least 250 psi (17.2 bar), at least 500 psi (34.5 bar), at least 1,000 psi (69.0 bar), at least 2,500 psi (172 bar), at least 5,000 psi (345 bar), at least 7,500 psi (517), at least 10,000 psi (689 bar), less than 10,000 psi (689 bar), less than 7,500 psi (517 bar), less than 5,000 psi (345 bar), less than 2,500 psi (172 bar), less than 1,000 psi (69.0 bar), less than 500 psi (34.5 bar), less than 250 psi (17.2 bar), and/or less than 150 psi (10.3 bar);

a specific compressive strength of at least 14.5 psi/(g/cc) (1.0 bar/(g/cc)), at least 25 psi/(g/cc) (1.7 bar/(g/cc)), at least 50 psi/(g/cc) (3.4 bar/(g/cc)), at least 75 psi/(g/cc) (5.2 bar/(g/cc)), at least 100 psi/(g/cc) (6.9 bar/(g/cc)), at least 150 psi/(g/cc) (10.3 bar/(g/cc)), at least 250 psi/(g/cc) (17.2 bar/(g/cc)), at least 500 psi/(g/cc) (34.5 bar/(g/cc)), at least 750 psi/(g/cc) (51.7 bar/(g/cc)), at least 1,000 psi/(g/cc) (68.9 bar/(g/cc)), at least 1,250 psi/(g/cc) (86.2 bar/(g/cc)), less than 1,500 psi/(g/cc) (103 bar/(g/cc)), less than 1,450 psi/(g/cc) (100 bar/(g/cc)), less than 1,400 psi/(g/cc) (96.5 bar/(g/cc)), less than 1,250 psi/(g/cc) (86.2 bar/(g/cc)), less than 1,000 psi/(g/cc) (68.9 bar/(g/cc)), less than 750 psi/(g/cc) (51.7 bar/(g/cc)), less than 500 psi/(g/cc) (34.5 bar/(g/cc)), less than 250 psi/(g/cc) (17.2 bar/(g/cc)), less than 150 psi/(g/cc) (10.3 bar/(g/cc)), less than 100 psi/(g/cc) (6.9 bar/(g/cc)), less than 75 psi/(g/cc) (5.2 bar/(g/cc)), less than 50 psi/(g/cc) (3.4 bar/(g/cc)), and/or less than 25 psi/(g/cc) (1.7 bar/(g/cc)); and/or a tensile strength of at least 125 psi (8.6 bar), at least 145 psi (10.0 bar), at least 150 psi (10.3 bar), at least 175 psi (12.1 bar), at last 200 psi (13.8 bar), at least 250 psi (17.2 bar), at least 500 psi (34.5 bar), at least 750 psi (51.7 bar), at least 1,000 psi (68.9 bar), at least 2,500 psi (172 bar), at least 5,000 psi (345 bar), at least 7,500 psi (571 bar), less than 10,000 psi (690 bar), less than 9,000 psi (621 bar), less than 7,500 psi (517 bar), less than 5,000 psi (345 bar), less than 2,500 psi (172 bar), less than 1,500 psi (103 bar), less than 1,000 psi (68.9 bar), less than 750 psi (51.7 bar), less than 500 psi (34.5 bar), less than 300 psi (20.7 bar), less than 250 psi (17.2 bar), less than 200 psi (13.8 bar), less than 175 psi (12.1 bar), and/or less than 150 psi (10.3 bar).

FIGS. 5-10 schematically depict illustrative, non-exclusive examples of portions of shot shells 100 that include an absorber 120 according to the present disclosure. Although the complete shot shell 100 is not shown in FIGS. 5-10, it is within the scope of the present disclosure that shot shell 100 of FIGS. 5-10 may include any of the components, features, variants, shapes, etc. that are described, illustrated, and/or incorporated herein with respect to shot shell 100 of FIGS. 2 and 4.

Figure 5:
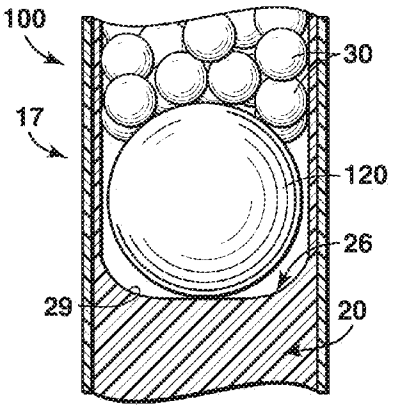
FIG. 5 is a schematic illustration of a portion of another shot shell containing an absorber according to the present disclosure.
Figure 10:
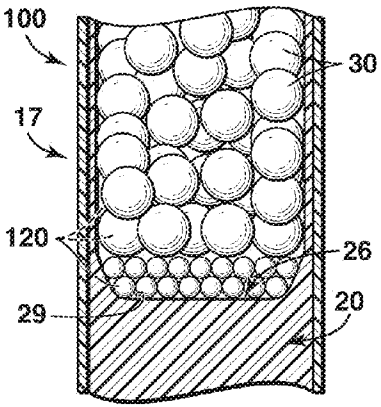
FIG. 10 is a schematic illustration of a portion of another shot shell containing an absorber according to the present disclosure.

In FIG. 5, absorber 120 takes the form of a sphere, or optionally a spheroid, that is positioned in wad 20 generally between shot cup 26 and pellets 30. During assembly of shot shell 100, for example, absorber 120 may be dropped or otherwise inserted into the wad prior to or after insertion of the wad into casing 17 and prior to insertion of shot pellets 30 into the wad. As illustrated, the sphere may have a diameter that is less than the internal (transverse) diameter of the shot shell's wad, such that the sphere does not simultaneously engage opposed internal sidewalls of the wad. As so illustrated, the sphere may be described as having a diameter that is approximately the inner diameter of the wad, but less (and optionally only slightly less) than the inner diameter of the wad. However, it is within the scope of the present disclosure that such a spherical (or otherwise shaped) absorber may have a diameter (or other cross-sectional area) that is as large as the inner diameter (or other cross-sectional area) of the wad and/or casing. It also is within the scope of the present disclosure that such a spherical (or otherwise shaped absorber) may have a diameter that is much smaller than the inner diameter of the wad, and in some embodiments may be sufficiently smaller than the inner diameter of the wad to permit a plurality of absorber spheres to be inserted into the wad, such as between the shot cup and the shot pellets, such as shown in FIG. 10.

Figure 7:
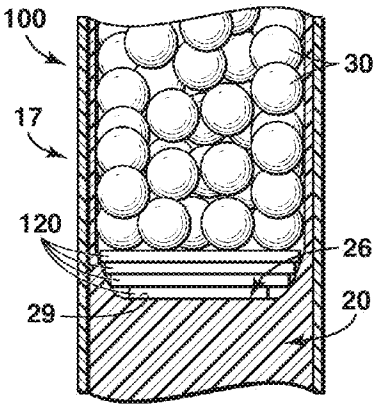
FIG. 7 is a schematic illustration of a portion of another shot shell containing an absorber according to the present disclosure.
Figure 6:
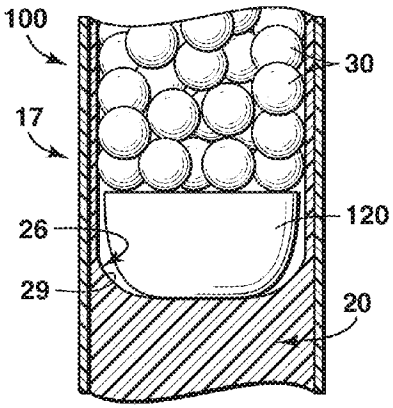
FIG. 6 is a schematic illustration of a portion of another shot shell containing an absorber according to the present disclosure.
Figure 9:
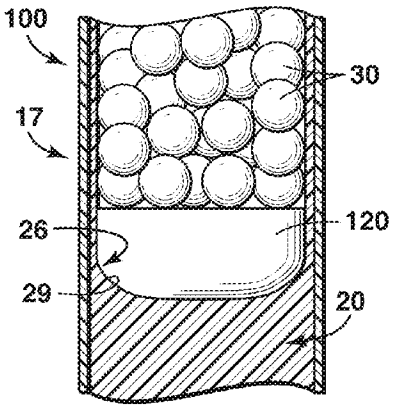
FIG. 9 is a schematic illustration of a portion of another shot shell containing an absorber according to the present disclosure.
Figure 8:
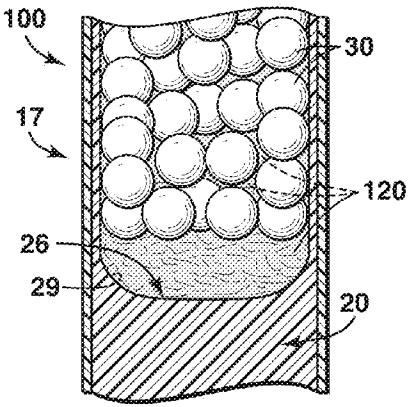
FIG. 8 is a schematic illustration of a portion of another shot shell containing an absorber according to the present disclosure.

In FIG. 6, absorber 120 takes the form of a hemisphere that is positioned in the wad generally between the shot cup and the shot pellets, and in FIG. 7 absorber 120 takes the form of a plurality of layers that are positioned in the wad generally between the shot cup and the shot pellets. In FIG. 7, four layers are schematically illustrated, but it is within the scope of the present disclosure that fewer or more layers may be used, and that the corresponding layers may or may not be secured together. In FIG. 8, absorber 120 takes the form of a plurality of pieces, or particles, such as may collectively form a layer, or absorber region, generally between the shot cup and the shot pellets. The depth of this region may vary within the scope of the present disclosure. It also is within the scope of the present disclosure that at least a portion of absorber 120 may extend into the payload region of the shot shell, such as to extend between adjacent shot pellets and/or between one or more shot pellets and an inner sidewall of the wad. Such an absorber 120 that extends into the payload region of shot shell 100 is illustrated in dashed lines in FIGS. 8 and 10. FIG. 9 schematically illustrates an absorber 120 that is shaped to conform to and/or match the shape of the shot cup of wad 20. In such an embodiment, the absorber may be shaped or otherwise foamed prior to insertion into the wad. Alternatively, the absorber may be poured, injected, or otherwise inserted into the wad as a liquid that conforms to the shape of the shot cup and/or other portion of the shot wad proximate the absorber and thereafter is cured or otherwise hardens to form a solid component having this shape.

Shot shells 100 with an absorber 120 according to the present disclosure additionally or alternatively may experience reduced imprinting, puncturing, and/or other penetration of the lower region of the wad by the shot pellets during firing of the shot shell, as compared to a corresponding shot shell that does not include absorber 120 but otherwise has the same components as shot shell 100. This reduced imprinting/penetration, such as in the lower third, or even half, of the wad (relative to the head region of the shell) means that fewer shot pellets are embedded into the wad than (on average) would be embedded therein if the shot shell did not include absorber 120. This reduction in the penetration of the wad by shot pellets when the shot shell is fired reduces the likelihood that shot pellets will penetrate through the wad and contact the shot gun's barrel, which in turn may reduce or even eliminate scoring of the shot gun's barrel when shot shells 100 are fired therein.

In experiments, shot shells 100 using an absorber 120 according to the present disclosure have improved the pellet velocity produced by a conventional 10-gauge shot shell from 1,300 feet per second (fps) (396.2 meters per second (m/s)) at the SAAMI maximum chamber pressure limit of 11,000 pounds per square inch (psi) (758.4 bar) to 1,500 fps (457.2 m/s) at a chamber pressure below 11,000 psi (758.4 bar). While not required to all embodiments, these experiments demonstrate how the inclusion of absorber 120 in a shot shell that otherwise is constructed of conventional components may enable a higher pellet velocity to be achieved without exceeding a maximum (rated/SAAMI) chamber pressure, or even at a lower chamber pressure than is generated by a comparable shot shell that produces lower velocity pellets. For example, and as discussed, with the addition of absorber 120, the resulting lower chamber pressure may permit the use of components (faster burning propellant, more propellant, etc.) that achieve higher pellet velocities.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Illustrative, non-exclusive examples of shot shells 100 and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

A1. A shot shell, comprising:

a housing containing a charge and defining an internal chamber;

a shot wad within the internal chamber and including a shot cup with a pellet-facing surface;

a plurality of shot pellets within the wad; and a force-absorbing absorber within the internal chamber and extending generally between the pellet-facing surface of the wad cup and the plurality of shot pellets.

A2. The shot shell of paragraph A1, wherein none of the plurality of shot pellets engage the pellet-facing surface of the wad cup.

A3. The shot shell of paragraph A1 or A2, wherein the absorber extends closer to the charge than the plurality of shot pellets.

A4. The shot shell of any of paragraphs A1-A3, wherein the absorber is not integral with the shot wad or the plurality of shot pellets.

A5. The shot shell of any of paragraphs A1-A4, wherein the absorber occupies a region of the internal chamber that would be occupied by the plurality of shot pellets but for the presence of the absorber.

A6. The shot shell of any of paragraphs A1-A5, wherein the absorber is configured to absorb a portion of setback forces that are generated when the shot shell is fired and to at least delay transmission of the forces to the plurality of shot pellets.

A7. The shot shell of any of paragraphs A1-A6, wherein the absorber is configured to absorb a portion of the energy produced when the shot shell is fired and thereby prevent generation of pressure from this portion of the energy within a shot gun's chamber when the shot shell is fired.

A8. The shot shell of any of paragraphs A1-A7, wherein the absorber is formed from a resilient material that is configured to absorb setback forces generated when the shot shell is fired and to impart at least a portion of the setback forces to the plurality of shot pellets as the absorber and the plurality of shot pellets travel after the shot shell is fired.

A9. The shot shell of any of paragraphs A1-A7, wherein the absorber is formed from a frangible material that is configured to absorb setback forces generated when the shot shell is fired and to break into particulate as the absorber and the plurality of shot pellets travel after the shot shell is fired.

A10. The shot shell of any of paragraphs A1-A9, wherein the absorber is at least one of spherical, semi-spherical, ovoid, and elliptical.

A11. The shot shell of any of paragraphs A1-A9, wherein the absorber is formed from a plurality of layers.

A12. The shot shell of any of paragraphs A1-A9, wherein the absorber takes the form of at least one cylindrical mat.

A13. The shot shell of any of paragraphs A1-A9, wherein the absorber includes a plurality of ball-shaped components.

A14. The shot shell of any of paragraphs A1-A9, wherein the absorber is shaped to conform to the pellet-facing surface of the shot cup.

A15. The shot shell of any of paragraphs A1-A9, wherein the absorber includes a plurality of unbound particles.

A16. The shot shell of any of paragraphs A1-A9, wherein the absorber includes granular particles.

A17. The shot shell of any of paragraphs A1-A9, wherein the absorber is molded to conform to the shape of the pellet-facing surface of the shot cup.

A18. The shot shell of any of paragraphs A1-A17, wherein the absorber is larger than any of the shot pellets of the plurality of shot pellets.

A19. The shot shell of any of paragraphs A1-A18, wherein the shot wad has an inner cross-sectional area measured transverse to the long axis of the shot shell, and further wherein the absorber has an outer cross-sectional area that is at least 50% of the inner cross-sectional area of the shot wad.

A20. The shot shell of any of paragraphs A1-A19, wherein the shot wad has an inner cross-sectional area measured transverse to the long axis of the shot shell, and further wherein the absorber has an outer cross-sectional area that is at least 75% of the inner cross-sectional area of the shot wad.

A21. The shot shell of any of paragraphs A1-A20, wherein the shot wad has an inner cross-sectional area measured transverse to the long axis of the shot shell, and further wherein the absorber has an outer cross-sectional area that is at least 90% of the inner cross-sectional area of the shot wad.

A22. The shot shell of any of paragraphs A1-A21, wherein the shot wad has an inner cross-sectional area measured transverse to the long axis of the shot shell, and further wherein the absorber has an outer cross-sectional area that is at least 95% of the inner cross-sectional area of the shot wad.

A23. The shot shell of any of paragraphs A1-A22, wherein the absorber covers at least 50% of the pellet-facing surface of the shot cup.

A24. The shot shell of any of paragraphs A1-A23, wherein the absorber covers at least 75% of the pellet-facing surface of the shot cup.

A25. The shot shell of any of paragraphs A1-A24, wherein the absorber covers at least 90% of the pellet-facing surface of the shot cup.

A26. The shot shell of any of paragraphs A1-A25, wherein the absorber covers the entire pellet-facing surface of the shot cup.

A27. The shot shell of any of paragraphs A1-A26, wherein the absorber further extends into a payload region of the shot shell that contains the plurality of shot pellets, with the absorber being intermixed with at least a portion of the shot pellets.

A28. The shot shell of any of paragraphs A1-A27, wherein the absorber has a Young's Modulus of less than 2,000 psi (137.9 bar).

A29. The shot shell of any of paragraphs A1-A28, wherein the absorber has a compressive strength that is at least 100 psi (6.9 bar) and which is less than 10,000 psi (689.5 bar).

A30. The shot shell of any of paragraphs A1-A29, wherein the absorber has a tensile strength of at least 145 psi (10 bar) and which is less than 10,000 psi (689.5 bar).

A31. The shot shell of any of paragraphs A1-A30, wherein the absorber includes, and optionally is formed from, cork.

A32. The shot shell of any of paragraphs A1-A30, wherein the absorber includes, and optionally is formed from, rubber.

A33. The shot shell of any of paragraphs A1-A30, wherein the absorber includes, and optionally is formed from, an elastomer.

A34. The shot shell of any of paragraphs A1-A30, wherein the absorber includes, and optionally is formed from, cardboard.

A35. The shot shell of any of paragraphs A1-A30, wherein the absorber includes, and optionally is formed from, expanded polystyrene.

A36. The shot shell of any of paragraphs A1-A30, wherein the absorber includes, and optionally is formed from, polystyrene.

A37. The shot shell of any of paragraphs A1-A30 wherein the absorber includes, and optionally is formed from, acrylonitrile butadiene styrene (ABS).

A38. The shot shell of any of paragraphs A1-A30, wherein the absorber includes, and optionally is formed from, a synthetic foam, such as synthetic foam of polyurethane, polystyrene, polyethylene or polypropylene.

A39. The shot shell of any of paragraphs A1-A30, wherein the absorber includes, and optionally is formed from, a different material than the wad and the plurality of pellets.

A40. The shot shell of any of paragraphs A1-A39, wherein the absorber has a Young's Modulus of less than 500,000 psi (34,474 bar), and optionally less than 250,000 psi (17,237 bar), and optionally less than 150,000 psi (10,342 bar), and optionally less than 100,000 psi (6,895 bar), and optionally less than 75,000 psi (5,171 bar), and optionally less than 50,000 psi (3,447 bar), and optionally less than 25,000 psi (1,724 bar), and optionally less than 10,000 psi (689 bar), and optionally less than 5,000 psi (345 bar), and optionally less than 2,500 psi (172 bar), and optionally less than 2,000 psi (138 bar), and optionally less than 1,500 psi (103 bar), and optionally in the range of 500-2,000 psi (34-138 bar), and optionally in the range of 1,000-3,000 psi (69-207 bar), and optionally in the range of 1,500-5,000 psi (103-35 bar), and optionally in the range of 5,000-20,000 psi (345-1379 bar).

A41. The shot shell of any of paragraphs A1-A40, wherein the absorber has a specific Young's Modulus of at least 1.45 psi/(g/cc) (0.10 bar/(g/cc)), and optionally at least 5 psi/(g/cc) (0.34 bar/(g/cc)), and optionally at least 10 psi/(g/cc) (0.69 bar/(g/cc)), and optionally at least 25 psi/(g/cc) (1.7 bar/(g/cc)), and optionally at least 50 psi/(g/cc) (3.5 bar/(g/cc)), and optionally at least 75 psi/(g/cc) (5.2 bar/(g/cc)), and optionally at least 100 psi/(g/cc) (6.9 bar/(g/cc)), and optionally at least 150 psi/(g/cc) (10.3 bar/(g/cc)), and optionally at least 200 psi/(g/cc) (13.8 bar/(g/cc)), and optionally at least 250 psi/(g/cc) (17.2 bar/(g/cc)).

A42. The shot shell of any of paragraphs A1-A41, wherein the absorber has a specific Young's Modulus of less than 300 psi/(g/cc) (20.7 bar/(g/cc)), and optionally less than 290 psi/(g/cc) (20.0 bar/(g/cc)), and optionally less than 250 psi/(g/cc) (17.2 bar/(g/cc)), and optionally less than 200 psi/(g/cc) (13.8 bar/(g/cc)), and optionally less than 150 psi/(g/cc) (10.3 bar/(g/cc)), and optionally less than 100 psi/(g/cc) (6.9 bar/(g/cc)), and optionally less than 75 psi/(g/cc) (5.2 bar/(g/cc)), and optionally less than 50 psi/(g/cc) (3.5 bar/(g/cc)), and optionally less than 25 psi/(g/cc) (1.7 bar/(g/cc)), and optionally less than 10 psi/(g/cc) (0.69 bar/(g/cc)), and optionally less than 5 psi/(g/cc) (0.34 bar/(g/cc)).

A43. The shot shell of any of paragraphs A1-A42, wherein the absorber has a compressive strength of at least 100 psi (6.9 bar), and optionally at least 250 psi (17.2 bar), and optionally at least 500 psi (34.5 bar), and optionally at least 1,000 psi (69.0 bar), and optionally at least 2,500 psi (172 bar), and optionally at least 5,000 psi (345 bar), and optionally at least 7,500 psi (517 bar), and optionally at least 10,000 psi (689 bar).

A44. The shot shell of any of paragraphs A1-A43, wherein the absorber has a compressive strength of less than 10,000 psi (689 bar), and optionally less than 7,500 psi (517 bar), and optionally less than 5,000 psi (345 bar), and optionally less than 2,500 psi (172 bar), and optionally less than 1,000 psi (69.0 bar), and optionally less than 500 psi (34.5 bar), and optionally less than 250 psi (17.2 bar), and optionally less than 150 psi (10.3 bar).

A45. The shot shell of any of paragraphs A1-A44, wherein the absorber has a specific compressive strength of at least 14.5 psi/(g/cc) (1.0 bar/(g/cc)), and optionally at least 25 psi/(g/cc) (1.7 bar/(g/cc)), and optionally at least 50 psi/(g/cc) (3.4 bar/(g/cc)), and optionally at least 75 psi/(g/cc) (5.2 bar/(g/cc)), and optionally at least 100 psi/(g/cc) (6.9 bar/(g/cc)), and optionally at least 150 psi/(g/cc) (10.3 bar/(g/cc)), and optionally at least 250 psi/(g/cc) (17.2 bar/(g/cc)), and optionally at least 500 psi/(g/cc) (34.5 bar/(g/cc)), and optionally at least 750 psi/(g/cc) (51.7 bar/(g/cc)), and optionally at least 1,000 psi/(g/cc) (68.9 bar/(g/cc)), and optionally at least 1,250 psi/(g/cc) (86.2 bar/(g/cc)).

A46. The shot shell of any of paragraphs A1-A45, wherein the absorber has a specific compressive strength of less than 1,500 psi/(g/cc) (103 bar/(g/cc)), and optionally less than 1,450 psi/(g/cc) (100 bar/(g/cc)), and optionally less than 1,400 psi/(g/cc) (96.5 bar/(g/cc)), and optionally less than 1,250 psi/(g/cc) (86.2 bar/(g/cc)), and optionally less than 1,000 psi/(g/cc) (68.9 bar/(g/cc)), and optionally less than 750 psi/(g/cc) (51.7 bar/(g/cc)), and optionally less than 500 psi/(g/cc) (34.5 bar/(g/cc)), and optionally less than 250 psi/(g/cc) (17.2 bar/(g/cc)), and optionally less than 150 psi/(g/cc) (10.3 bar/(g/cc)), and optionally less than 100 psi/(g/cc) (6.9 bar/(g/cc)), and optionally less than 75 psi/(g/cc) (5.2 bar/(g/cc)), and optionally less than 50 psi/(g/cc) (3.4 bar/(g/cc)), and optionally less than 25 psi/(g/cc) (1.7 bar/(g/cc)).

A47. The shot shell of any of paragraphs A1-A46, wherein the absorber has a tensile strength of at least 125 psi (8.6 bar), and optionally at least 145 psi (10.0 bar), and optionally at least 150 psi (10.3 bar), and optionally at least 175 psi (12.1 bar), and optionally at last 200 psi (13.8 bar), and optionally at least 250 psi (17.2 bar), and optionally at least 500 psi (34.5 bar), and optionally at least 750 psi (51.7 bar), and optionally at least 1,000 psi (68.9 bar), and optionally at least 2,500 psi (172 bar), and optionally at least 5,000 psi (345 bar), and optionally at least 7,500 psi (571 bar).

A48. The shot shell of any of paragraphs A1-A47, wherein the absorber has a tensile strength of less than 10,000 psi (690 bar), and optionally less than 9,000 psi (621 bar), and optionally less than 7,500 psi (517 bar), and optionally less than 5,000 psi (345 bar), and optionally less than 2,500 psi (172 bar), and optionally less than 1,500 psi (103 bar), and optionally less than 1,000 psi (68.9 bar), and optionally less than 750 psi (51.7 bar), and optionally less than 500 psi (34.5 bar), and optionally less than 300 psi (20.7 bar), and optionally less than 250 psi (17.2 bar), and optionally less than 200 psi (13.8 bar), and optionally less than 175 psi (12.1 bar), and optionally less than 150 psi (10.3 bar).

A49. The shot shell of any of paragraphs A1-A48, wherein the shot shell is a 10 gauge shot shell, and further wherein, when fired, the plurality of shot pellets travel at speeds of at least 1,400 feet per second (fps) (426.7 m/s), and optionally at least 1,500 fps (457.2 m/s) while pressures of less than 11,000 psi (758.4 bar) are generated in the shot gun's chamber.

B1. In a shot shell containing a plurality of shot pellets, the improvement comprising an energy absorber between the shot cup and the plurality of shot pellets.

B2. The shot shell of paragraph B1, further comprising any permissible combination of the subject matter recited in any of paragraphs A2-A49.

C1. A method for assembling a shot shell, the method comprising:

inserting a shot wad into a shot shell housing;

inserting an energy absorber into a shot cup region of the shot wad; and inserting a plurality of shot pellets into the shell housing and into engagement with the absorber.

C2. The method of paragraph C1, wherein the absorber is inserted into the shot cup region of the shot wad prior to the absorber and the shot wad being inserted into the shot shell housing.

C3. The method of paragraph C1, wherein the absorber is inserted into the shot cup region of the shot wad after the shot wad is inserted into the shot shell housing.

C4. The method of any of paragraphs C1-C3, wherein the absorber is inserted as a solid material into the wad.

C5. The method of any of paragraphs C1-C3, wherein the absorber is inserted into the wad as a liquid and thereafter solidified.

C6. The method of any of paragraphs C1-C5, further comprising sealing a mouth region of the shot shell.

C7. The method of any of paragraphs C1-C6, further comprising adding a primer and a propellant to the shot shell.

C8. The method of paragraph C7, wherein the propellant is selected to generate more than a maximum rated pressure for a shot gun when the shot shell is fired from a chamber of the shot gun, and further wherein the method includes absorbing at least a portion of setback energy produced when the shot shell is fired to prevent the maximum rated pressure from being exceeded.

C9. The method of any of paragraphs C1-C8, wherein the shot shell further comprises any permissible combination of the subject matter recited in any of paragraphs A2-A49.

INDUSTRIAL APPLICABILITY

The systems and methods disclosed herein are applicable to the firearms and hunting industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method for assembling a shot shell, the method comprising:

inserting a shot wad into a shot shell housing, wherein the shot wad includes a partition that separates a propellant region and a payload region of the shot wad, and further wherein the shot wad includes a shot cup region that defines a pellet-facing surface that faces generally away from the partition and elongate sidewalls that extend from the pellet-facing surface away from the partition;

inserting an energy absorber into the shot cup region of the shot wad and into engagement with the pellet-facing surface of the shot cup region; wherein the inserting an energy absorber includes inserting, into the shot cup region of the shot wad, a liquid that is thereafter solidified to form the absorber; and inserting a plurality of shot pellets into the shell housing and into engagement with the absorber.

2. The method of claim 1, wherein the absorber is inserted into the shot cup region of the shot wad prior to the absorber and the shot wad being inserted into the shot shell housing.

3. The method of claim 1, wherein the absorber is inserted into the shot cup region of the shot wad after the shot wad is inserted into the shot shell housing.

4. The method of claim 1, wherein the liquid is inserted into the wad and thereafter solidified by curing to form the absorber.

5. The method of claim 1, wherein the inserting an energy absorber into the shot cup region occurs prior to the inserting of a plurality of shot pellets into the shot wad.

6. The method of claim 1, wherein the absorber, when solidified, is frangible.

7. The method of claim 1, wherein the absorber is configured to absorb a portion of setback forces that are generated when the shot shell is fired and to at least delay transmission of the forces to the plurality of shot pellets.

8. The method of claim 1, wherein the absorber is configured to absorb a portion of the energy produced when the shot shell is fired and thereby prevent generation of pressure from this portion of the energy within a shot gun's chamber when the shot shell is fired.

9. The method of claim 1, wherein the absorber is formed from a resilient material that is configured to absorb setback forces generated when the shot shell is fired and to impart at least a portion of the setback forces to the plurality of shot pellets as the absorber and the plurality of shot pellets travel after the shot shell is fired.

10. The method of claim 1, wherein the absorber is formed from a frangible material that is configured to absorb setback forces generated when the shot shell is fired and to break into particulate as the absorber and the plurality of shot pellets travel after the shot shell is fired.

11. The method of claim 1, wherein the absorber has a Young's Modulus of less than 2,000 psi (137.9 bar).

12. The method of claim 1, wherein the absorber has a compressive strength that is at least 100 psi (6.9 bar) and which is less than 10,000 psi (689.5 bar).

13. The method of claim 1, wherein the absorber has a tensile strength of at least 145 psi (10 bar) and which is less than 10,000 psi (689.5 bar).

14. A shot shell produced by the method of claim 1.

15. The shot shell of claim 14, wherein none of the plurality of shot pellets engage the pellet-facing surface of the shot cup.

16. The shot shell of claim 14, wherein the absorber is shaped to conform to the pellet-facing surface of the shot cup.

17. The shot shell of claim 14, wherein the absorber covers at least 75% of the pellet-facing surface of the shot cup.

18. The shot shell of claim 14, wherein the absorber covers at least 90% of the pellet-facing surface of the shot cup.

19. The shot shell of claim 14, wherein the shot shell is a 10 gauge shot shell, and further wherein, when fired, the plurality of shot pellets travel at speeds of at least 1,400 feet per second (fps) (426.7 m/s) while pressures of less than 11,000 psi (758.4 bar) are generated in the shot gun's chamber.

20. The shot shell of claim 14, wherein the absorber extends between adjacent shot pellets of the plurality of shot pellets.

21. The shot shell of claim 14, wherein the absorber extends between the pellets of the plurality of shot pellets and an inside wall of the shot wad.

* * * * *